US005887944A

United States Patent [19]

Boost

[11] Patent Number: 5,887,944

[45] Date of Patent: Mar. 30, 1999

[54] ROCKING CHAIR APPARATUS

[76] Inventor: Julie Ann Boost, 21 Vanguard Dr., Cocoa, Fla. 32926

[21] Appl. No.: 104,249

[22] Filed: Jun. 24, 1998

Related U.S. Application Data

[60] Provisional application No. 60/054,027 Jul. 28, 1997.

[51] Int. Cl.[6] ..... A47C 3/02; A47D 13/10

[52] U.S. Cl. ..... 297/258.1; 297/271.5; 297/259.1

[58] Field of Search ..... 297/258.1, 271.5, 297/260.1, 259.1; 472/25; 482/78, 130; 446/325, 396

[56] References Cited

U.S. PATENT DOCUMENTS

| | | | |
|---|---|---|---|
| 2,237,475 | 4/1941 | Church | 297/229 |
| 2,878,858 | 3/1959 | Winchester | 472/25 |
| 2,988,358 | 6/1961 | Mills | 297/271.5 |
| 3,041,070 | 6/1962 | Kerstein . | |
| 3,749,399 | 7/1973 | Fedor et al. | 472/25 |
| 3,893,731 | 7/1975 | Maggo . | |
| 4,025,107 | 5/1977 | Chippa | 297/258.1 |
| 4,084,273 | 4/1978 | Haynes . | |
| 4,109,960 | 8/1978 | Stinchfield . | |
| 4,141,588 | 2/1979 | Anderson . | |
| 5,603,662 | 2/1997 | Kreaman-Stern | 472/25 |

FOREIGN PATENT DOCUMENTS

| | | | |
|---|---|---|---|
| 1028369 | 3/1978 | Canada | 472/25 |

*Primary Examiner*—Peter M. Cuomo
*Assistant Examiner*—Anthony D. Barfield

[57] ABSTRACT

A rocking chair apparatus includes a round, dish-like base which includes a concave interior surface and a convex exterior surface. A chair retained on the concave interior surface of the base. The chair includes a seat portion supported by a bottom portion of the concave interior surface. The base includes an axis of symmetry, and the axis of symmetry passes through a central portion of the seat portion. A back portion of the chair is formed by a portion of the base. When a person, especially a child, sits on the chair in the base, the person can rock back and forth on the convex exterior surface of the base. Also, the person can cause the rocking chair apparatus to spin or swivel around on the convex exterior surface. A wall extension is connected to the back portion of the base. The chair further includes a seat cushion supported by the seat portion of the base. A back cushion is connected to the seat cushion and supported by the back portion of the base, and a back extension cushion is connected to the back cushion. The back extension cushion is supported by the wall extension. The seat cushion, the back cushion, and the back extension cushion are formed as a unified cushion structure. Handles are connected to the base. The handles are connected to an upper rim of the base. A ballast weight member is supported by the base under the seat portion of the chair.

7 Claims, 2 Drawing Sheets

FIG 3
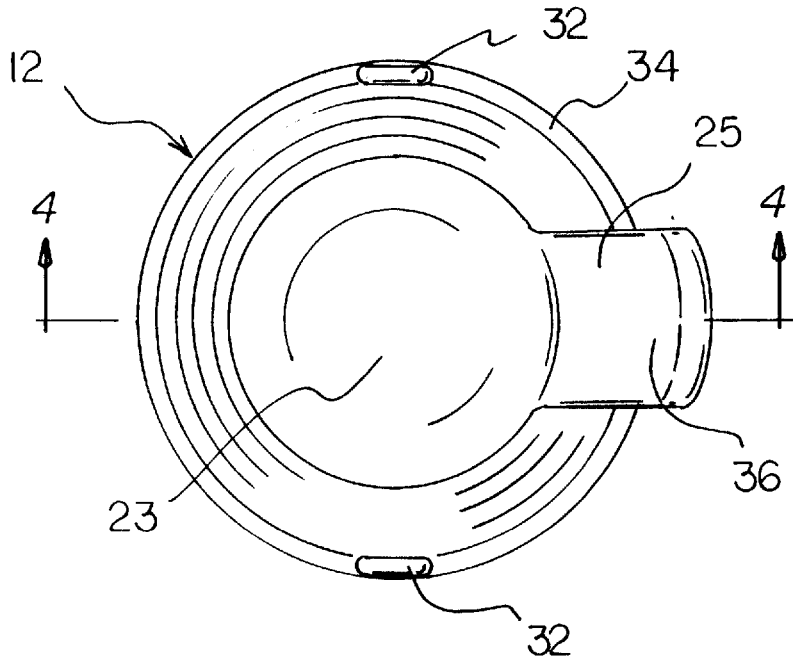
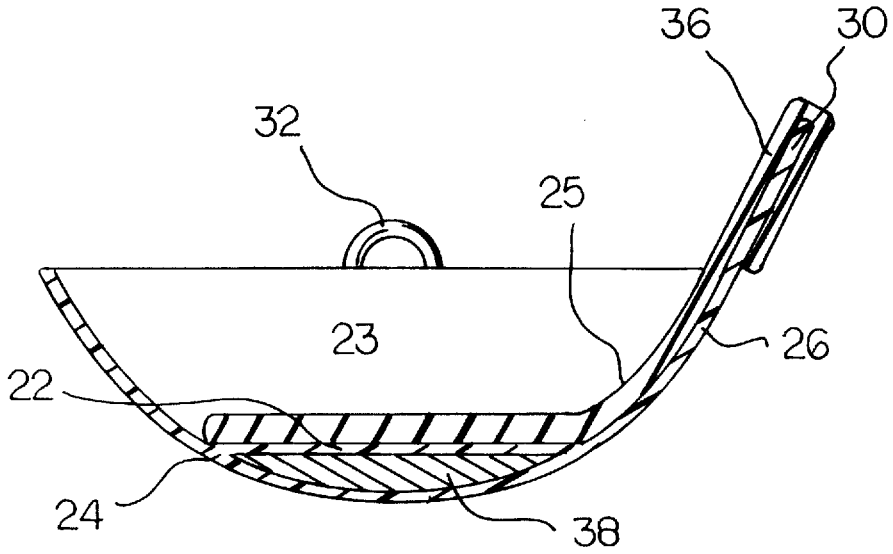
FIG 4

ROCKING CHAIR APPARATUS

BACKGROUND OF THE INVENTION

CROSS REFERENCE TO RELATED APPLICATION

This application claims priority based upon my prior copending Provisional Application Ser. No. 60/054,027, filed Jul. 28, 1997.

1. Field of the Invention

The present invention relates generally to chairs, and, more particularly to rocking chairs.

2. Description of the Prior Art

Rocking chairs having bowl-shaped bases are well known in the art. In this respect, throughout the years, a number of innovations have been developed relating to rocking chairs having bowl-shaped bases, and the following U. S. patents are representative of some of those innovations: U.S. Pat. No. 3,041,070, 4,084,273, and 4,141,588. More specifically, U.S. Pat. No. 3,041,070 discloses a rocking chair which has a bowl-shaped base. The seat portion is located at the periphery of circumference of the bowl-shaped base. As a result, if only one person is seated on the seat portion in the rocking chair, it would be difficult for the seated person to spin the rocking chair smoothly. To provide for smooth spinning of the rocking chair, it would be desirable if a seat portion were not located at the circumference of the rocking chair.

U.S. Pat. No. 4,084,273 discloses a rocking chair which has a bowl-shaped base wherein a seat portion is not attached to a special back portion to form a chair having both a seat portion and a back portion. For comfort of the person seated on the seat portion, it would be desirable if a rocking chair having a bowl-shaped base were provided which has a special back portion attached to the seat portion.

U.S. Pat. No. 4,141,588 discloses a rocking chair having a bowl-shaped base. An axis of symmetry for the bowl-shaped base passes through an edge portion of the seat. However, to promote a different spinning effect, it would be desirable if a rocking chair having a bowl-shaped base were provided which has an axis of symmetry which passes through both the bowl-shaped base and the seat portion.

As a matter of interest, U.S. Pat. No. 3,893,731 discloses a chair having a seat portion and a back portion; and U.S. Pat. No. 4,109,960 discloses a rocking chair which does not include a bowl-shaped base.

Still other features would be desirable in a rocking chair apparatus. For example, it would be desirable if a rocking chair having a bowl-shaped base were provided with a cushioned seat portion and a cushioned back portion. Also, to provide added stability, it would be desirable if a rocking chair having a bowl-shaped base were provided which includes ballast weight. In addition, to add to spinning control and to a feeling of security of a person seated in the rocking chair device, it would be desirable if handles were present on the bowl-shaped base.

Thus, while the foregoing body of prior art indicates it to be well known to use rocking chairs which have bowl-shaped bases, the prior art described above does not teach or suggest a rocking chair apparatus which has the following combination of desirable features: (1) has a seat portion which is not located only at the circumference of the rocking chair; (2) has a special back portion attached to the seat portion; (3) has an axis of symmetry which passes through both the bowl-shaped base and the seat portion; (4) includes a cushioned seat portion and a cushioned back portion; (5) includes ballast weight; and (6) includes handles on the bowl-shaped base. The foregoing desired characteristics are provided by the unique rocking chair apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a rocking chair apparatus which includes a round, dish-like base which includes a concave interior surface and a convex exterior surface. A chair retained on the concave interior surface of the base. The chair includes a seat portion supported by a bottom portion of the concave interior surface. The base includes an axis of symmetry, and the axis of symmetry passes through a central portion of the seat portion. A back portion of the chair is formed by a portion of the base. When a person, especially a child, sits on the chair in the base, the person can rock back and forth on the convex exterior surface of the base. Also, the person can cause the rocking chair apparatus to spin or swivel around on the convex exterior surface.

A wall extension is connected to the back portion of the base. The chair further includes a seat cushion supported by the seat portion of the base. A back cushion is connected to the seat cushion and supported by the back portion of the base, and a back extension cushion is connected to the back cushion. The back extension cushion is supported by the wall extension. The seat cushion, the back cushion, and the back extension cushion are formed as a unified cushion structure. Handles are connected to the base. The handles are connected to an upper rim of the base. A ballast weight member is supported by the base under the seat portion of the chair.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved rocking chair apparatus which has all of the advantages of the prior art and none of the disadvantages.

It is another object of the present invention to provide a new and improved rocking chair apparatus which may be easily and efficiently manufactured and marketed.

It is a further object of the present invention to provide a new and improved rocking chair apparatus which is of durable and reliable construction.

An even further object of the present invention is to provide a new and improved rocking chair apparatus which is susceptible of a low cost of manufacture with regard to both materials and labor, and which accordingly is then susceptible of low prices of sale to the consuming public, thereby making such rocking chair apparatus available to the buying public.

Still yet a further object of the present invention is to provide a new and improved rocking chair apparatus which seat portion is not located only at the circumference of the rocking chair.

Still another object of the present invention is to provide a new and improved rocking chair apparatus that has a special back portion attached to the seat portion.

Yet another object of the present invention is to provide a new and improved rocking chair apparatus which has an axis of symmetry which passes through both the bowl-shaped base and the seat portion.

Even another object of the present invention is to provide a new and improved rocking chair apparatus that includes a cushioned seat portion and a cushioned back portion.

Still a further object of the present invention is to provide a new and improved rocking chair apparatus which includes ballast weight.

Yet another object of the present invention is to provide a new and improved rocking chair apparatus that includes handles on the bowl-shaped base.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 3 is an enlarged top view of the embodiment of the rocking chair apparatus of FIG. 2.

FIG. 4 is a cross-sectional view of the embodiment of the invention shown in FIG. 3 taken along line 4—4 thereof.

DESCRIPTION OF THE PREFERRED EMBODIMENT

With reference to the drawings, a new and improved rocking chair apparatus embodying the principles and concepts of the present invention will be described.

Figure 1:
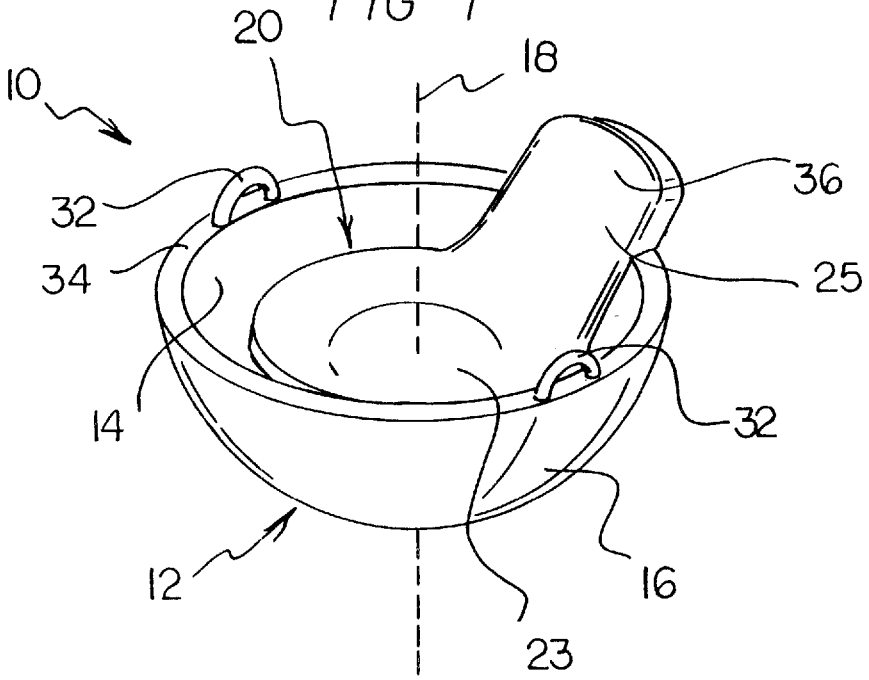
FIG. 1 is a perspective view showing a preferred embodiment of the rocking chair apparatus of the invention.
Figure 2:
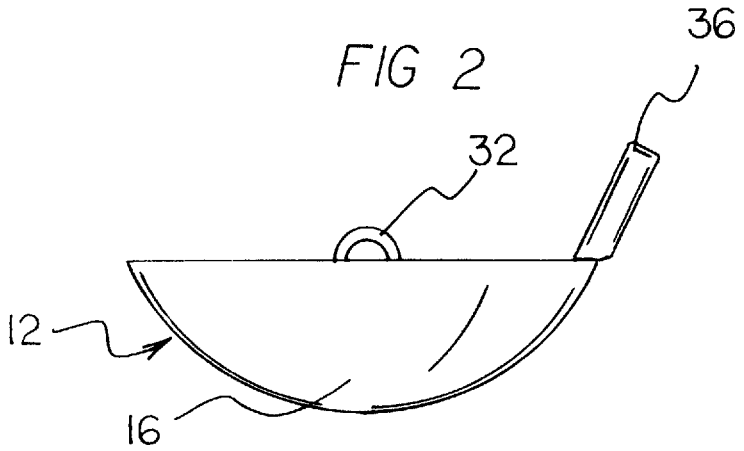
FIG. 2 is a side view of the embodiment of the rocking chair apparatus shown in FIG. 1.

Turning to FIGS. 1–4, there is shown an exemplary embodiment of the rocking chair apparatus of the invention generally designated by reference numeral 10. In its preferred form, rocking chair apparatus 10 includes a round, dish-like base 12 which includes a concave interior surface 14 and a convex exterior surface 16. A chair 20 is retained on the concave interior surface 14 of the base 12. The chair 20 includes a seat portion 22 supported by a bottom portion 24 of the concave interior surface 14. A back portion 26 of the chair 20 is formed by a portion of the base 12. When a person, especially a child, sits on the chair 20 in the base 12, the person can rock back and forth on the convex exterior surface 16 of the base 12. Also, the person can cause the rocking chair apparatus 10 to spin or swivel around on the convex exterior surface 16.

A wall extension 30 is connected to the back portion 26 of the base 12. The chair 20 further includes a seat cushion 23 supported by the seat portion 22 of the base 12. A back cushion 25 is connected to the seat cushion 23 and is supported by the back portion 26 of the base 12. A back extension cushion 36 is connected to the back cushion 25. The back extension cushion 36 is supported by the wall extension 30. The seat cushion 23, the back cushion 25, and the back extension cushion 36 are formed as a unified cushion structure. The base 12 includes an axis of symmetry 18. When a person spins the rocking chair apparatus 10 on the base 12, often the rocking chair apparatus 10 is caused to spin or swivel around the axis of symmetry 18. The axis of symmetry 18 passes through a central portion of seat portion 22.

Handles 32 are connected to the base 12. The handles 32 are connected to an upper rim 34 of the base 12. A ballast weight member 38 is supported by the base 12 under the seat portion 22 of the chair 20. The ballast weight member 38 provides a low level weight for lowering the center of gravity of the rocking chair apparatus 10 to prevent the rocking chair apparatus 10 from tipping over during rocking.

The base 12 can be made of a hard, durable plastic material in the form of a half of a sphere that is hollowed out. The seat cushion 23, back cushion 25, and back extension cushion 36 can be made from soft continuous material, or they can be made from confined particulate material, such as bean bag material. The handles 32 can be grasped for control during rocking and spinning. The back extension cushion 36 and the wall extension 30 of the base 12 provide support for a person's head when seated in the chair 20. The back extension cushion 36 can be provided with a pocket that receives the wall extension 30. The rocking chair apparatus 10 can be provided in a variety of sizes, colors, and weights.

The components of the rocking chair apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved rocking chair apparatus that is low in cost, relatively simple in design and operation, and which may advantageously be used without having a seat portion located only at the circumference of the rocking chair. With the invention, a rocking chair apparatus is provided which has a special back portion attached to the seat portion. With the invention, a rocking chair apparatus is provided which has an axis of symmetry which passes through both the bowl-shaped base and the seat portion. With the invention, a rocking chair apparatus is provided which includes a cushioned seat portion and a cushioned back portion. With the invention, a rocking chair apparatus is provided which includes ballast weight. With the invention, a rocking chair apparatus is provided which includes handles on the bowl-shaped base.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A rocking chair apparatus, comprising:

a round, dish-like base which includes a circumferential rim, a concave interior surface, a convex exterior surface, said concave interior surface and said convex exterior surface extending from said circumferential rim to define said round, dish-like base, a chair retained on said concave interior surface of said base, wherein said chair includes a seat portion supported by a bottom portion of said concave interior surface, wherein said base includes an axis of symmetry, and wherein said axis of symmetry passes through a central portion of said seat portion;

wherein a back portion of said chair is formed by a portion of said base, said apparatus further including a wall extension connected to said back portion of said base, said wall extension extending beyond said rim; said wall extension having an extent along said rim less than the circumferential extent of said rim.

2. The apparatus of claim 1 wherein said chair further includes:

a seat cushion supported by said seat portion of said chair, a back cushion connected to said seat cushion and supported by said back portion of said base, and a back extension cushion connected to said back cushion, wherein said back extension cushion is supported by said wall extension.

3. The apparatus of claim 2 wherein said back extension cushion includes a pocket for receiving at least a portion of said wall extension.

4. The apparatus of claim 2 wherein said seat cushion, said back cushion, and said back extension cushion are formed as a unified cushion structure.

5. The apparatus of claim 1, further including:

handles connected to said base.

6. The apparatus of claim 1 wherein said handles are connected to said rim of said base.

7. The apparatus of claim 1, further including:

a ballast weight member supported by said base under said seat portion of said chair.

* * * * *